US009751193B2

(12) United States Patent
Evatt et al.

(10) Patent No.: US 9,751,193 B2
(45) Date of Patent: Sep. 5, 2017

(54) CLAMPING AND SPREADING TOOL

(71) Applicant: Techtronic Power Tools Technology Limited, Tortola (VG)

(72) Inventors: Thomas Evatt, Six Mile, SC (US); Richard Davidian, Pickens, SC (US); Anthony Tocco, Easley, SC (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 633 days.

(21) Appl. No.: 14/193,168

(22) Filed: Feb. 28, 2014

(65) Prior Publication Data

US 2014/0265084 A1 Sep. 18, 2014

Related U.S. Application Data

(60) Provisional application No. 61/792,634, filed on Mar. 15, 2013.

(51) Int. Cl.
*B25B 5/06* (2006.01)
*B25B 27/14* (2006.01)
(Continued)

(52) U.S. Cl.
CPC ..... *B25B 5/068* (2013.01); *B25B 5/163* (2013.01); *B25B 5/166* (2013.01); *B25B 5/102* (2013.01); *Y10T 29/53683* (2015.01)

(58) Field of Classification Search
CPC ..... B25B 5/102; B25B 5/127; B25B 5/16; B25B 5/06; B25B 5/068; B25B 5/166;
(Continued)

(56) References Cited

U.S. PATENT DOCUMENTS 661,488 A 11/1900 Broadbooks
1,376,017 A 4/1921 Johnsen
(Continued)

FOREIGN PATENT DOCUMENTS

CN 20245583 11/2011
CN 202045584 11/2011
(Continued)

OTHER PUBLICATIONS

Irwin, "Quick-Grip, Clamping Tools" p. 25-32, publicly available at least as early as Nov. 15, 2012.

*Primary Examiner* — Larry E Waggle, Jr.
*Assistant Examiner* — Mahdi H Nejad
(74) *Attorney, Agent, or Firm* — Michael Best & Friedrich LLP

(57) ABSTRACT

A tool for providing a clamping force and a spreading force in the opposite direction of the clamping force. The tool includes a handle assembly having a trigger and a bar supported by the handle assembly. The bar is configured to move relative to the handle assembly when the trigger is actuated, and the bar includes a slot spanning from a first end of the bar to a second end of the bar. An inner rod is received within the slot, and a detent mechanism selectively couples the inner rod to the bar. The inner rod is received within the first end and coupled to the bar to provide the clamping force when the trigger is actuated, and the inner rod is received within the second end and coupled to the bar to provide the spreading force when the trigger is actuated.

18 Claims, 12 Drawing Sheets

(51) Int. Cl.
*B25B 5/16* (2006.01)
*B25B 5/10* (2006.01)

(58) Field of Classification Search
CPC ..... B25B 5/163; B25B 5/006; B25B 5/101; B25B 5/003; Y10T 29/53683
USPC ..... 269/149, 6, 146, 3, 147, 208, 9, 8, 88, 269/89, 90, 211, 156, 86, 257, 151, 278, 269/258, 203, 188, 207, 216, 166
See application file for complete search history.

(56) References Cited

U.S. PATENT DOCUMENTS 1,447,603 A 3/1923 Runner
1,554,899 A 9/1925 Vick
1,583,611 A * 5/1926 Seely ..... B25B 5/10 269/146
1,918,017 A 7/1933 Christ
1,930,177 A * 10/1933 Miller ..... B25B 5/102 269/147
2,277,576 A 3/1942 Anderson
3,061,302 A 10/1962 Dennis
3,697,046 A 10/1972 Sur
3,934,316 A 1/1976 Driscoll
4,257,584 A 3/1981 Sterling
4,449,704 A 5/1984 Goulter
4,834,354 A * 5/1989 Yang ..... B25B 5/003 269/156
4,850,254 A 7/1989 Burney
4,893,801 A 1/1990 Flinn
4,926,722 A 5/1990 Sorensen et al.
5,005,449 A 4/1991 Sorensen et al.
5,009,134 A 4/1991 Sorensen et al.
5,022,137 A 6/1991 Sorensen et al.
D320,919 S 10/1991 Sorensen
D328,846 S 8/1992 Sorensen et al.
D331,180 S 11/1992 Sorensen
5,161,787 A 11/1992 Hobday
D333,602 S 3/1993 Gatzemeyer et al.
5,197,360 A 3/1993 Wooster, Jr.
D357,165 S 4/1995 Sorensen et al.
5,454,551 A 10/1995 Hobday
D366,819 S 2/1996 Wooster, Jr. et al.
D366,820 S 2/1996 Wooster, Jr. et al.
5,549,225 A 8/1996 Lii
5,584,458 A 12/1996 Rando
5,626,263 A 5/1997 Lii
5,709,372 A 1/1998 Lii
5,732,936 A 3/1998 Lii
5,775,680 A 7/1998 Sorensen et al.
5,853,168 A 12/1998 Drake
5,988,616 A 11/1999 Full
6,029,964 A 2/2000 Bohl
6,089,556 A * 7/2000 Whiteford ..... B25B 1/12 269/143
6,189,878 B1 * 2/2001 Meese ..... B25B 5/142 269/156
D440,139 S 4/2001 Michell
6,254,073 B1 7/2001 Noniewicz et al.
6,302,386 B1 10/2001 Fuller et al.
6,338,475 B1 1/2002 Ping
6,347,791 B1 2/2002 Chervenak
6,367,787 B1 4/2002 Poole et al.
6,382,608 B1 5/2002 Michell
6,386,530 B1 5/2002 Marks
6,412,767 B1 7/2002 Beckmann et al.
6,474,632 B1 11/2002 Liou
6,530,565 B1 3/2003 Simpson
6,585,243 B1 7/2003 Li
6,648,315 B1 11/2003 Lee
6,655,670 B1 12/2003 Liou
6,676,120 B1 1/2004 Hallbeck et al.
6,701,596 B2 3/2004 Kloepfer et al.
D488,043 S 4/2004 Ben-Gigi
6,746,006 B2 * 6/2004 Thomas ..... B25B 5/163 269/166
6,848,683 B2 2/2005 Foshag et al.
6,896,248 B1 5/2005 Andulics
6,929,253 B2 8/2005 Marks
6,957,808 B2 10/2005 Varzino et al.
6,978,986 B2 12/2005 Chang
D516,892 S 3/2006 Ping
7,017,894 B1 3/2006 Lin
7,040,609 B1 5/2006 Liou
7,066,457 B2 6/2006 Gerritsen et al.
7,090,209 B1 8/2006 Rowlay
7,093,828 B2 8/2006 Murray et al.
7,114,713 B2 10/2006 Brass et al.
7,114,715 B1 * 10/2006 Kirk ..... B25B 5/068 269/147
7,159,858 B2 1/2007 Ben-Gigi
7,168,181 B2 1/2007 Walchak
7,172,183 B1 2/2007 Yang
D541,613 S 5/2007 Wang
D541,614 S 5/2007 Wang
7,222,842 B2 5/2007 Lin
D545,162 S 6/2007 Ranieri
7,226,046 B2 6/2007 Kloepfer et al.
7,258,333 B2 8/2007 Hobday
D555,454 S 11/2007 Noniewicz
7,322,571 B2 1/2008 Springer
7,322,572 B1 1/2008 Yang
7,325,797 B2 2/2008 Kloepfer et al.
7,389,978 B2 6/2008 Rowlay et al.
7,396,004 B2 * 7/2008 Kern ..... B25B 5/003 269/3
7,398,966 B2 7/2008 Hubbard
7,513,492 B1 4/2009 Kuo
7,530,556 B1 5/2009 Zheng
D597,814 S 8/2009 Yang
7,600,744 B2 10/2009 Liou
7,604,224 B2 10/2009 Rowlay
7,614,617 B2 11/2009 Marusiak
7,624,974 B2 12/2009 Zheng
7,641,183 B2 1/2010 Fuller et al.
7,651,078 B2 1/2010 Geier et al.
7,699,297 B2 4/2010 Cicenas et al.
7,735,813 B2 6/2010 Geier et al.
D619,441 S 7/2010 Yang
D622,121 S 8/2010 Weinberg et al.
7,784,774 B2 8/2010 Fuller et al.
7,815,175 B2 10/2010 Cicenas et al.
7,896,322 B2 3/2011 Geler et al.
7,896,323 B2 3/2011 Murray et al.
7,909,314 B2 3/2011 Roesch et al.
7,942,392 B2 5/2011 Geier et al.
7,954,794 B2 6/2011 Fuller et al.
7,984,895 B2 7/2011 Strauss et al.
8,016,276 B2 9/2011 Geier et al.
8,074,340 B2 12/2011 Cicenas et al.
8,079,577 B2 12/2011 Simon
8,091,874 B2 1/2012 Ray Avalani
8,167,288 B2 5/2012 Despins et al.
8,177,203 B2 5/2012 Alexander
8,177,209 B2 5/2012 Chen
8,240,647 B2 8/2012 Geier et al.
D668,127 S 10/2012 Yang
8,366,089 B2 2/2013 Chen
8,424,856 B2 4/2013 Lombardi et al.
8,430,383 B2 4/2013 Strauss
8,544,831 B2 10/2013 Klein et al.
8,556,243 B2 10/2013 Chen
8,590,871 B2 11/2013 Geier et al.
2003/0075851 A1 * 4/2003 Alford ..... B25B 1/103 269/147
2003/0080485 A1 5/2003 Lo
2003/0141644 A1 * 7/2003 Thomas ..... B25B 5/163 269/6
2004/0040127 A1 3/2004 Hellkamp
2005/0121842 A1 6/2005 Lo
2005/0248074 A1 11/2005 Ray Avalani
2005/0280196 A1 12/2005 Ray Avalani
2006/0043660 A1 3/2006 Ping

(56) References Cited

U.S. PATENT DOCUMENTS

| | | | | |
|---|---|---|---|---|
| 2006/0226588 | A1 | 10/2006 | Khachatoorian et al. | |
| 2006/0255519 | A1 | 11/2006 | Noniewicz | |
| 2007/0090580 | A1 | 4/2007 | Fratianne | |
| 2007/0138724 | A1 | 6/2007 | Gibbons et al. | |
| 2007/0176342 | A1 | 8/2007 | Noniewicz | |
| 2007/0187879 | A1 | 8/2007 | Ben-Gigi | |
| 2008/0136077 | A1 | 6/2008 | Yang | |
| 2008/0237959 | A1* | 10/2008 | Tseng | B25B 5/068 269/86 |
| 2009/0206534 | A1 | 8/2009 | McCracken | |
| 2010/0084798 | A1 | 4/2010 | Geier et al. | |
| 2011/0068310 | A1 | 3/2011 | Despins et al. | |
| 2011/0079946 | A1 | 4/2011 | Yang | |
| 2011/0227269 | A1 | 9/2011 | Zheng | |
| 2012/0098182 | A1 | 4/2012 | Yang | |
| 2012/0187617 | A1 | 7/2012 | Kuo | |
| 2012/0193853 | A1 | 8/2012 | Patel et al. | |
| 2012/0304424 | A1 | 12/2012 | Yang | |
| 2013/0015617 | A1 | 1/2013 | Yang | |
| 2013/0099437 | A1 | 4/2013 | Liu | |
| 2013/0134642 | A1 | 5/2013 | Chen | |
| 2013/0264758 | A1 | 10/2013 | Kuo | |
| 2013/0264759 | A1* | 10/2013 | Kuo | B25B 5/068 269/6 |

FOREIGN PATENT DOCUMENTS

| | | |
|---|---|---|
| DE | 8703379 | 9/1987 |
| DE | 9319867 | 6/1994 |
| DE | 102004019941 | 11/2005 |
| DE | 202006002404 | 5/2006 |
| DE | 202006003377 | 7/2006 |
| EP | 0080960 | 6/1983 |
| EP | 1574291 | 9/2005 |
| EP | 1908555 | 4/2008 |
| EP | 2145735 | 1/2010 |
| GB | 2375985 | 4/2002 |
| TW | M412832 | 10/2011 |
| TW | M412833 | 10/2011 |
| WO | WO 82/04006 | 11/1982 |
| WO | WO 99/44789 | 9/1999 |
| WO | WO 2005/087438 | 9/2005 |
| WO | WO 2007/070885 | 6/2007 |
| WO | WO 2009/095300 | 8/2009 |
| WO | WO 2010/000001 | 1/2010 |
| WO | WO 2012/036596 | 3/2012 |
| WO | WO 2012/068033 | 5/2012 |

* cited by examiner

CLAMPING AND SPREADING TOOL

CROSS-REFERENCE TO RELATED APPLICATIONS

This application claims the benefit of U.S. Provisional Patent Application No. 61/792,634, filed on Mar. 15, 2013, the contents of which are incorporated herein by reference.

BACKGROUND

The present invention relates to tools and in particular a tool that functions as both a clamp and a spreader.

SUMMARY

In one aspect, the invention provides a tool for providing a clamping force and a spreading force in the opposite direction of the clamping force. The tool includes a handle assembly having a trigger and a bar supported by the handle assembly. The bar is configured to move relative to the handle assembly when the trigger is actuated, and the bar includes a slot spanning from a first end of the bar to a second end of the bar. An inner rod is received within the slot, and a detent mechanism selectively couples the inner rod to the bar. The inner rod is received within the first end and coupled to the bar to provide the clamping force when the trigger is actuated, and the inner rod is received within the second end and coupled to the bar to provide the spreading force when the trigger is actuated.

In another aspect, the invention provides a tool including a handle assembly and a bar supported by the handle assembly. The bar is configured to move relative to the handle assembly. An inner rod is coupled to the bar and a detent mechanism is coupled to the bar and configured to selectively lock the inner rod to the bar. The inner rod is adjusted relative to the bar to vary a span of the tool.

In another aspect, the invention provides a hand tool including a handle assembly having a trigger and a bar supported by the handle assembly. The bar is configured to move relative to the handle assembly when the trigger is actuated. A telescoping inner rod is adjustably coupled to the bar to vary the span of the tool and to switch the tool from a clamping configuration to a spreading configuration.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
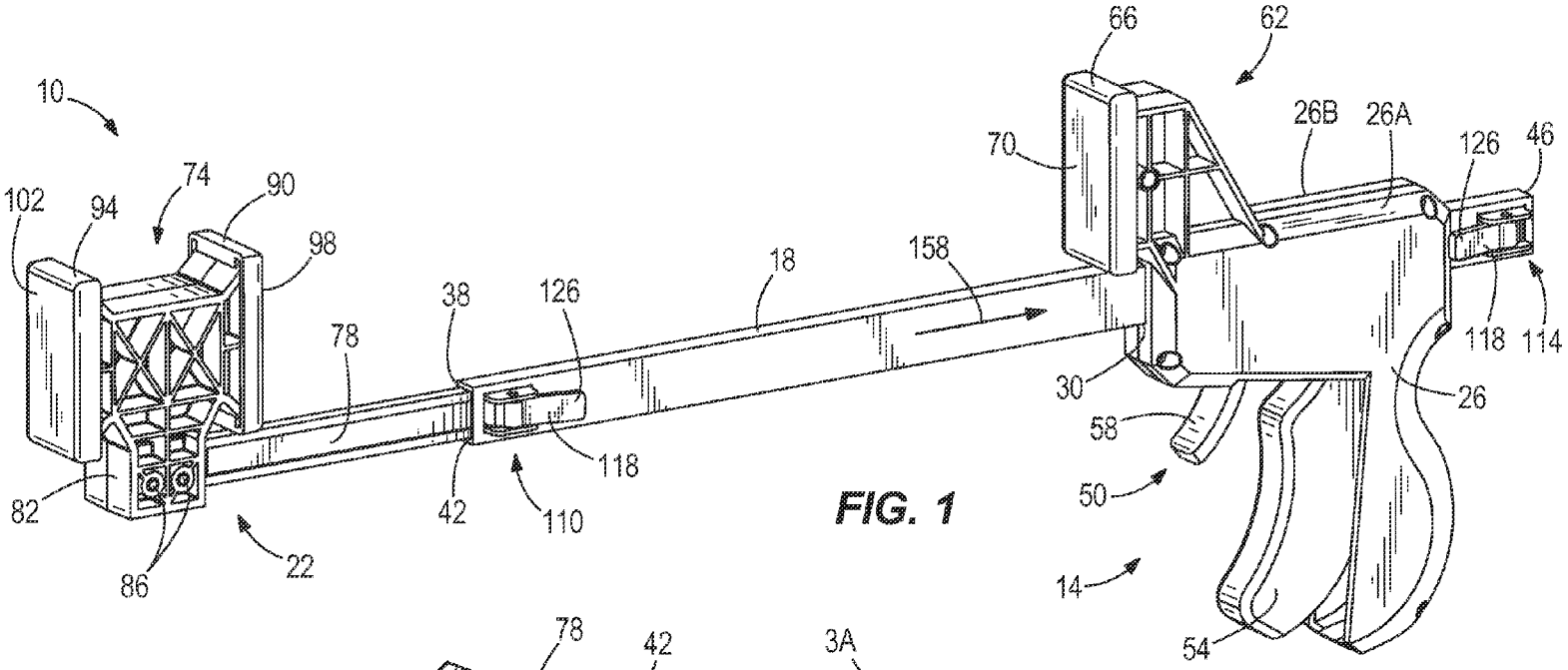
FIG. 1 a perspective view of a combination clamp and spreader tool in a clamping configuration.
Figure 2:
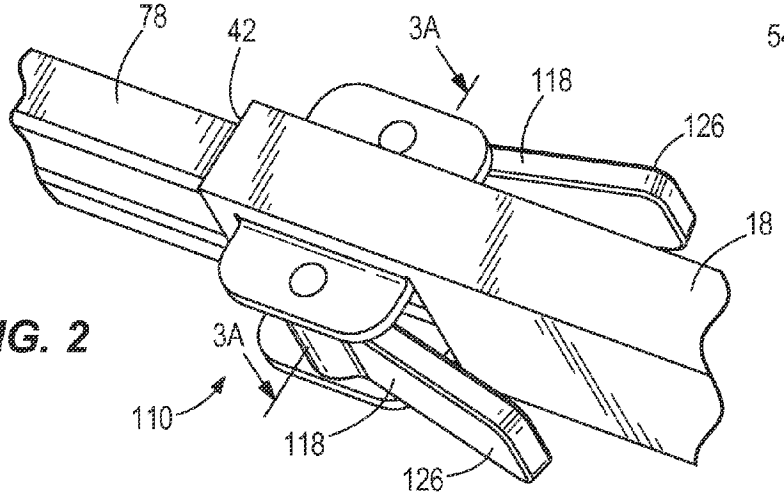
FIG. 2 is a partial perspective view of a detent mechanism of the combination clamp and spreader tool of FIG. 1.

FIG. 1 illustrates a combination clamp and spreader tool 10 in a clamping configuration. The combination clamp and spreader tool 10 includes a handle assembly 14, a slidable bar 18, and an inner rod assembly 22. The handle assembly 14 includes a housing 26, formed of two mating shells 26A, 26B that define a first aperture 30 and a second aperture 34 when coupled together. The slidable bar 18 is supported by the handle assembly 14 and is inserted through the housing 26, passing through the first aperture 30 and second aperture 34. The slidable bar 18 includes a center slot 38 spanning from a first end 42 to a second end 46. The handle assembly 14 further includes an actuation assembly 50 having a trigger 54 and a release trigger 58 for controlling the movement of the slidable bar 18, the operation of which is explained below. A first jaw portion 62 is formed as part of the housing 26 and includes a first pad 66, made of an elastomer or other such material, defining a first engagement surface 70.

The inner rod assembly 22 includes a second jaw portion 74 coupled to an inner rod 78 with two pins 86 at a first end 82. The second jaw portion 74 includes a second pad 90 and a third pad 94, both similar to the first pad 42. The second pad 90 defines a second engagement surface 98 and the third pad 94 defines a third engagement surface 102. The first surface 70 and the second surface 98 are the working surfaces of the tool 10 when in the clamping configuration, shown in FIG. 1 (i.e., the actuation assembly 50 forces the first surface 70 and second surface 98 together). The first surface 70 and the third surface 102 are the working surfaces of the tool 10 when in a spreading configuration, shown in FIG. 7 (i.e., the actuation assembly 50 forces the first surface 70 and third surface 102 apart). The inner rod 78 is received by the center slot 38 of the slidable bar 18 from either the first end 42 for the clamping configuration or the second end 46 for the spreading configuration. The inner rod 78 is completely separable from the slidable bar 18. The inner rod 78 includes four slots 106 spaced along the inner rod 78 for adjusting the span of the combination clamp and spreader tool 10 while in either the clamping or spreading configuration (i.e., the adjustable inner rod is telescopically coupled to the slidable bar 18). The span of the combination clamp and spreader tool 10 is equal to the distance from the second jaw portion 74 of the inner rod assembly 22 to the second end 46 of the slidable bar 18 in clamping configuration or to the first end 42 of the slidable bar 18 in the spreading configuration.

Figure 3A:
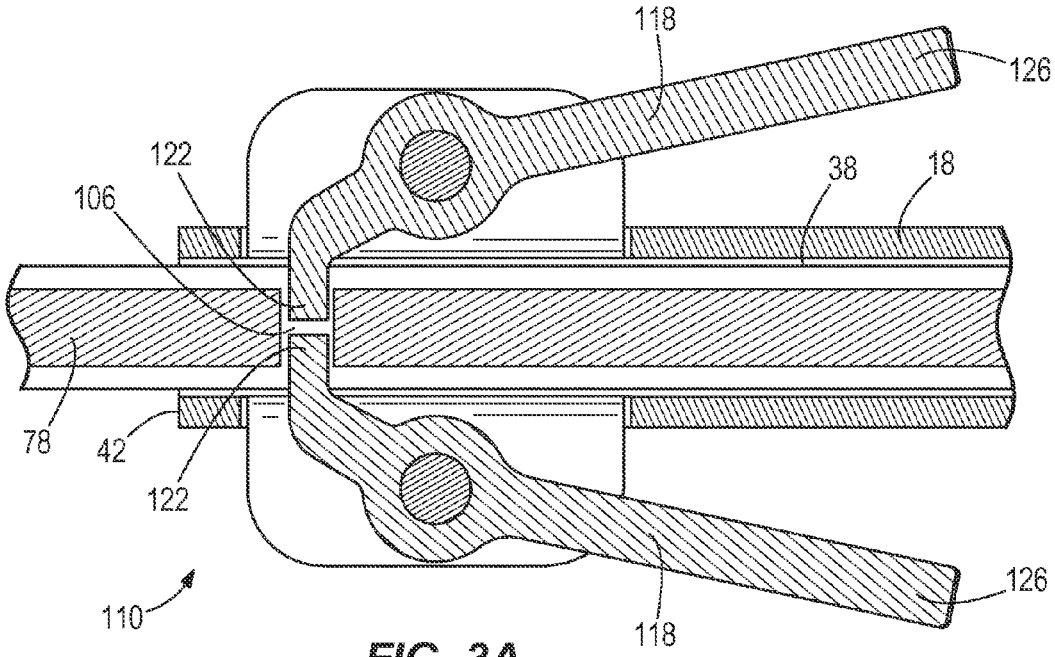
FIG. 3A is a cross-sectional view of the detent mechanism of FIG. 2 in a locking, first position.
Figure 3B:
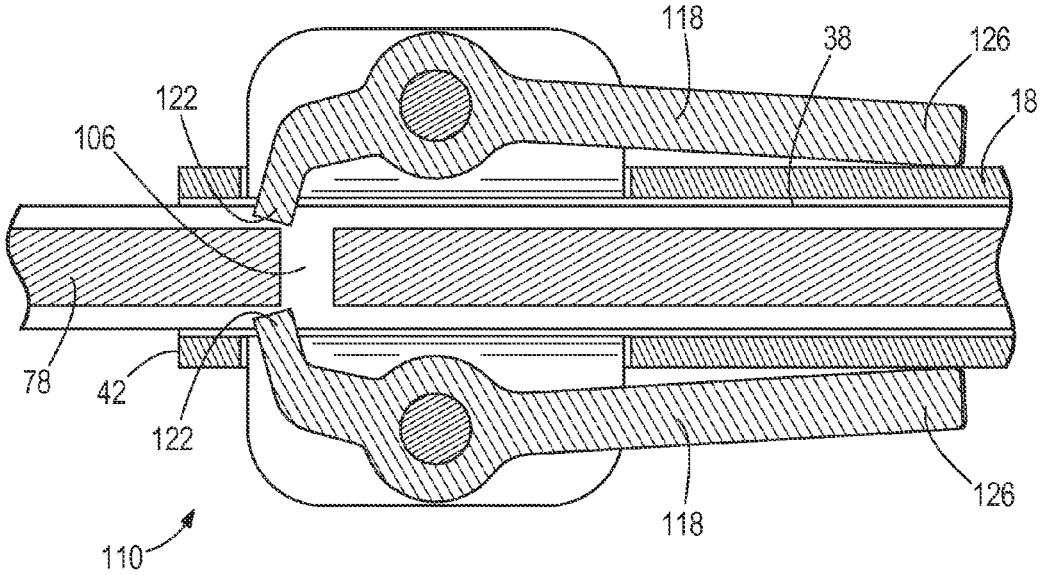
FIG. 3B is a cross-sectional view of the detent mechanism of FIG. 2 in a released, second position.

The slidable bar 18 further includes a first detent mechanism 110 proximal to the first end 42 and a second detent mechanism 114 proximal to the second end 46 for selectively locking the inner rod 78 to the slidable bar 18 via the slots 106. The detent mechanisms 110, 114 each include two pivotable clips 118 mounted on each side of the slidable bar 18. FIG. 3A shows the clips 118 pivoted in a first, locking condition where a tab portion 122 of the clip 118 is inserted into the slot 106 of the inner rod 78. FIG. 3B shows the clips 118 pivoted to a second, released condition where the tab portion 122 of the clips 118 are removed from the slot 106, allowing the inner rod 78 to slide relative to the slidable bar 18. The clips 118 are moved from the lock position to the released position by, for example, a user depressing a lever portion 126 of the clips 118 toward the slidable bar 18. In some embodiments, the clips 118 are biased by a torsional spring (not shown) to the locked condition, while in others, the clips 118 are held in the locked condition by an interference fit with the slot 106.

Figure 10:
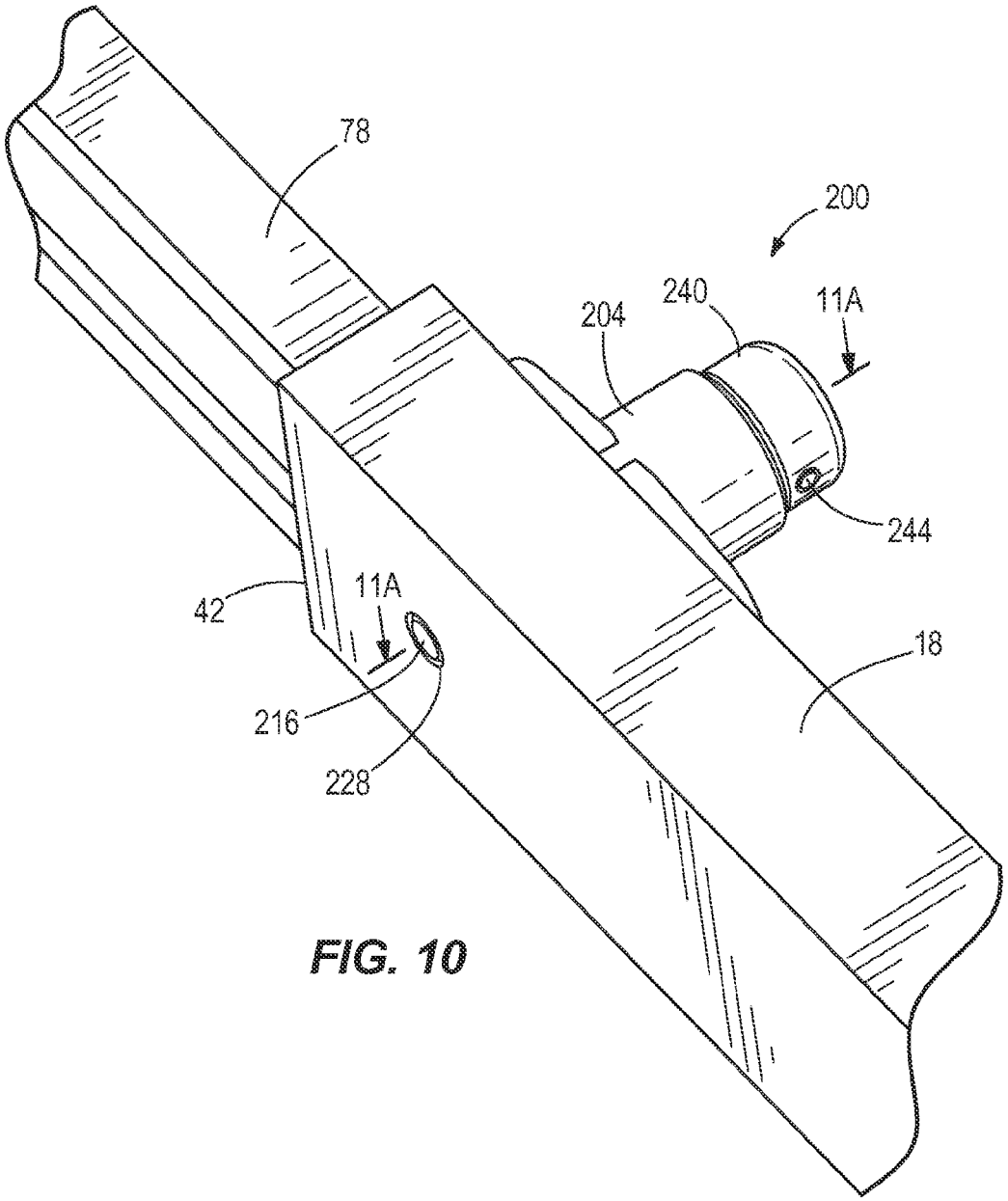
FIG. 10 is a partial perspective view of a detent mechanism of a combination clamp and spreader tool according to another embodiment of the invention.
Figure 11A:
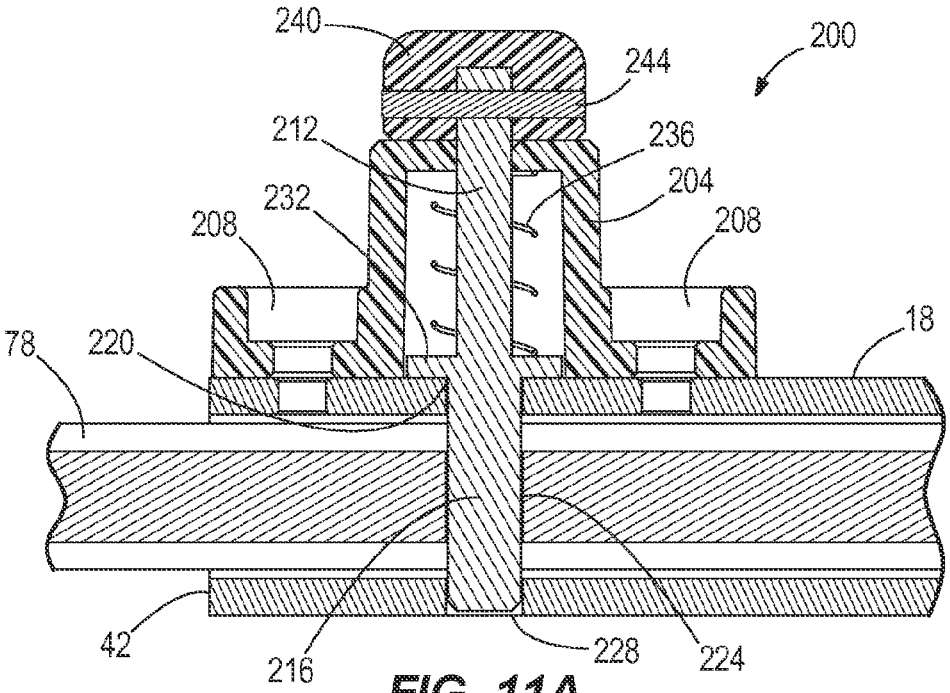
FIG. 11A is a cross-sectional view of the detent mechanism of FIG. 10 in a locking, first position.
Figure 11B:
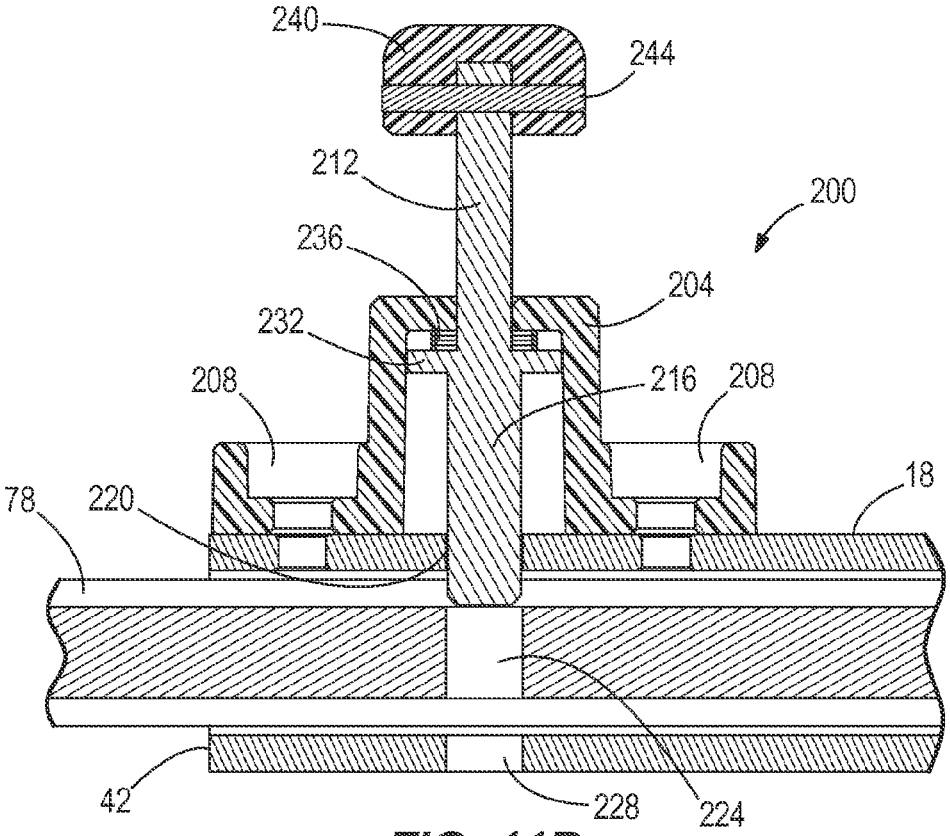
FIG. 11B is a cross-sectional view of the detent mechanism of FIG. 10 in a released, second position.

FIGS. 10, 11A and 11B illustrate a detent mechanism 200 of a clamp and spreader tool according to another embodiment of the invention. The detent mechanism 200 includes a detent housing 204 coupled to the slidable bar 18 via fasteners 208. The detent mechanism 200 further includes a plunger 212 positioned partially within the detent housing 204. With reference to FIG. 11A, the plunger 212 includes a detent portion 216, and when the detent mechanism 200 is in a first, locked position, the detent portion 216 passes through a first aperture 220 in the slidable bar 18, through an aperture 224 of the inner rod 78, and into a second aperture 228 on the opposite side of the slidable bar 18. The aperture 224 of the inner rod 78 is similar to the slots 106 of the above-described embodiment, and multiple apertures 224 are spaced along the inner rod 78 to provide adjustable span. With the detent portion 216 inserted into the aperture 224, the inner rod 78 is fixed relative to the slidable bar 18. The plunger 212 further includes a plate 232 formed on the plunger 212 against which a spring 236 positioned within the detent housing 204, biases the detent portion 216 toward the inner rod 78. The detent mechanism 200 further includes a knob 240 fixedly attached to the plunger 212 via a pin 244. With reference to FIG. 11B, the knob 240 is graspable by a user to pull the plunger 212 partially out of the detent housing 204 while compressing the spring 236 and removing the detent portion 216 from the aperture 224 in a second, released position. In the second, released position, the inner rod 78 is free to slide relative to the slidable bar 18. When the knob 240 is released by the user, the spring 236 biases the detent portion 216 back toward the inner rod 78 and the inner rod 78 will continue to slide relative to the slidable bar 18 until the detent portion 216 of the plunger 212 is received into the next aperture 224. The detent mechanism 200 is proximal to both the first end 42 and the second end 46 of the slidable bar 18.

Figure 4A:
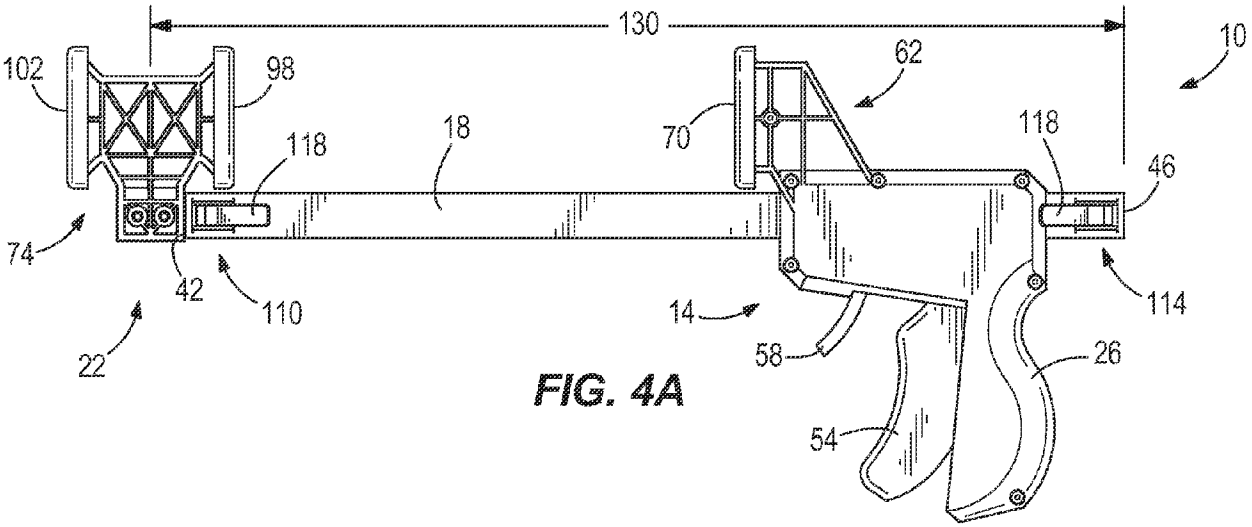
FIG. 4A is side view of the combination clamp and spreader tool of FIG. 1 in the clamping configuration with a first span.
Figure 4B:
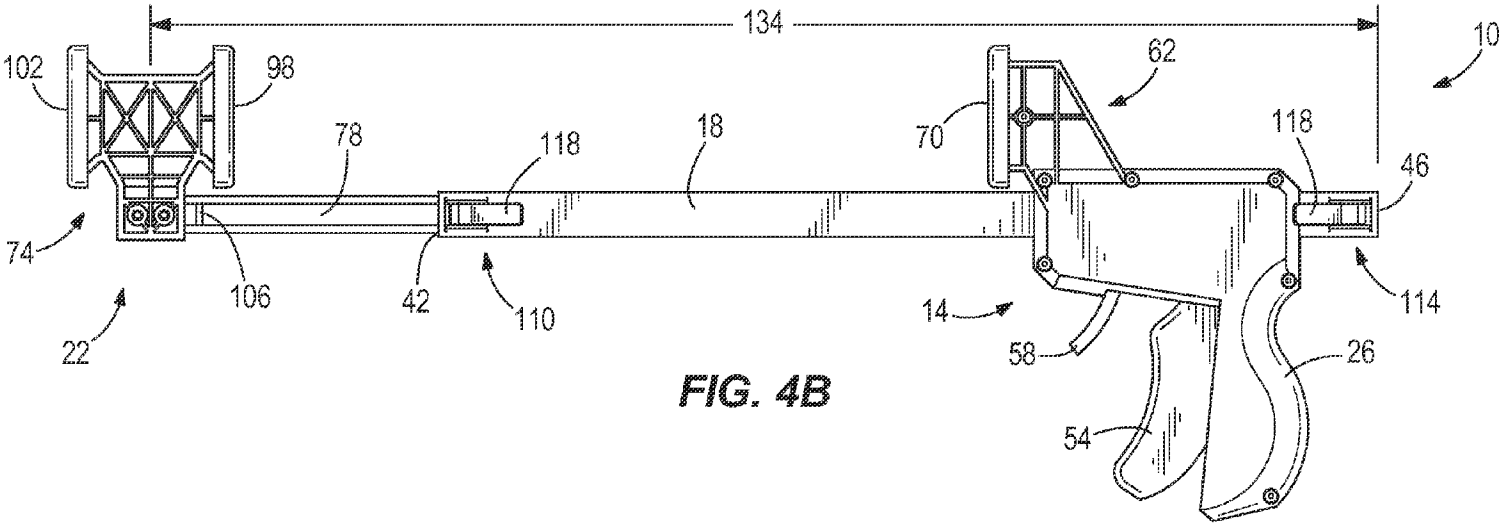
FIG. 4B is a side view of the combination clamp and spreader tool of FIG. 1 in the clamping configuration with a second span.
Figure 4C:
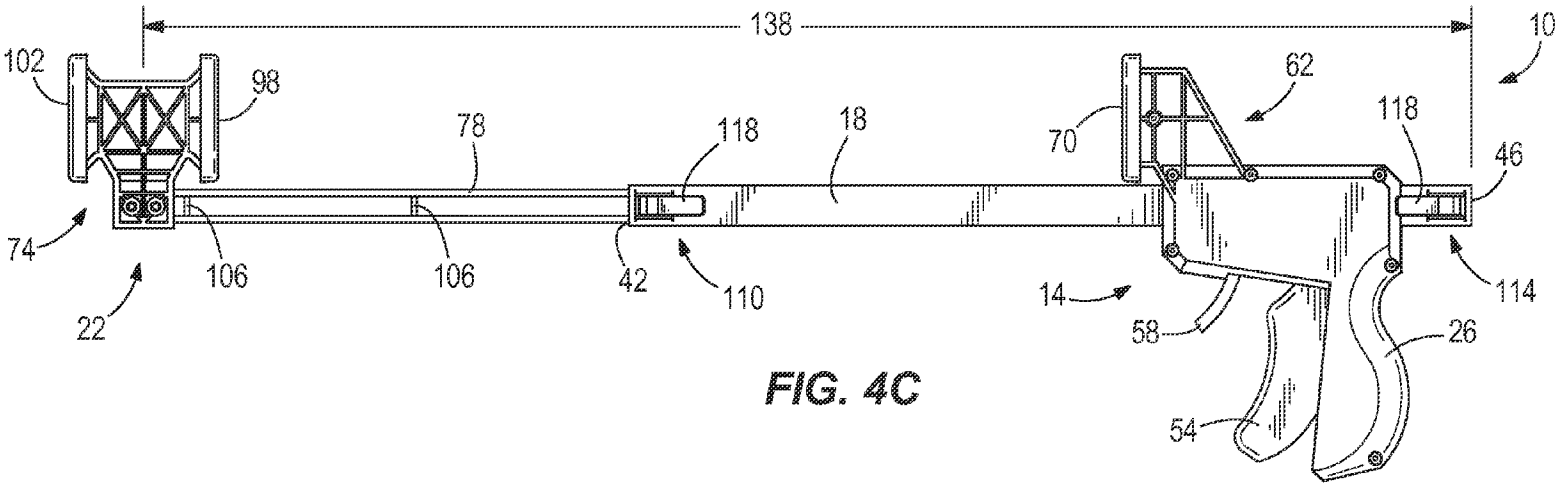
FIG. 4C is a side view of the combination clamp and spreader tool of FIG. 1 in the clamping configuration with a third span.
Figure 4D:
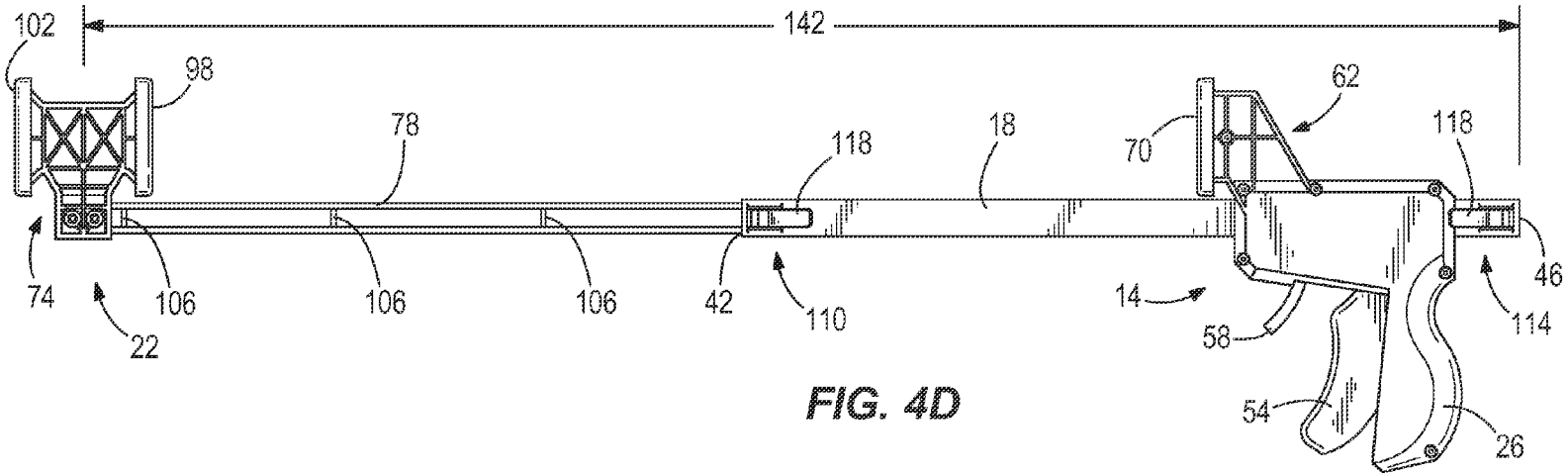
FIG. 4D is a side view of the combination clamp and spreader tool of FIG. 1 in the clamping configuration with a fourth span.

With reference to FIG. 4A, the span of the combination clamp and spreader tool 10 is thereby determined by adjustably locking the inner rod 78 to the slidable rod 18 by one of the detent mechanisms 110, 114 engaging a slot 106 on the inner rod 78. FIG. 4A illustrates the clamp and spreader tool 10 in the clamping configuration with a first span 130 defined from the second jaw portion 74 to the second end 46. The first span 130 corresponds to the detent mechanism 110 engaging the slot 106 closest to the second jaw portion 74. Similarly, FIG. 4B illustrates the clamp and spreader tool 10 in the clamping configuration with a second span 134. The second span 134 is larger than the first span 130. The second span 134 corresponds to the detent mechanism 110 engaging the next slot 106 along the inner rod 78. Increasing the span of the clamp and spreader tool 10 while in the clamping configuration allows for a larger workpiece to be placed between the first engagement surface 70 and second engagement surface 98. FIG. 4C illustrates the clamp and spreader tool 10 with a third span 138 and FIG. 4D illustrates a fourth span 142. The forth span 142 is larger than the third span 138, which is larger than the second span 134. Each span corresponds to the detent mechanism 110 locking the inner rod 78 to the slidable rod 18 at one of the four slots 106.

Figure 5:
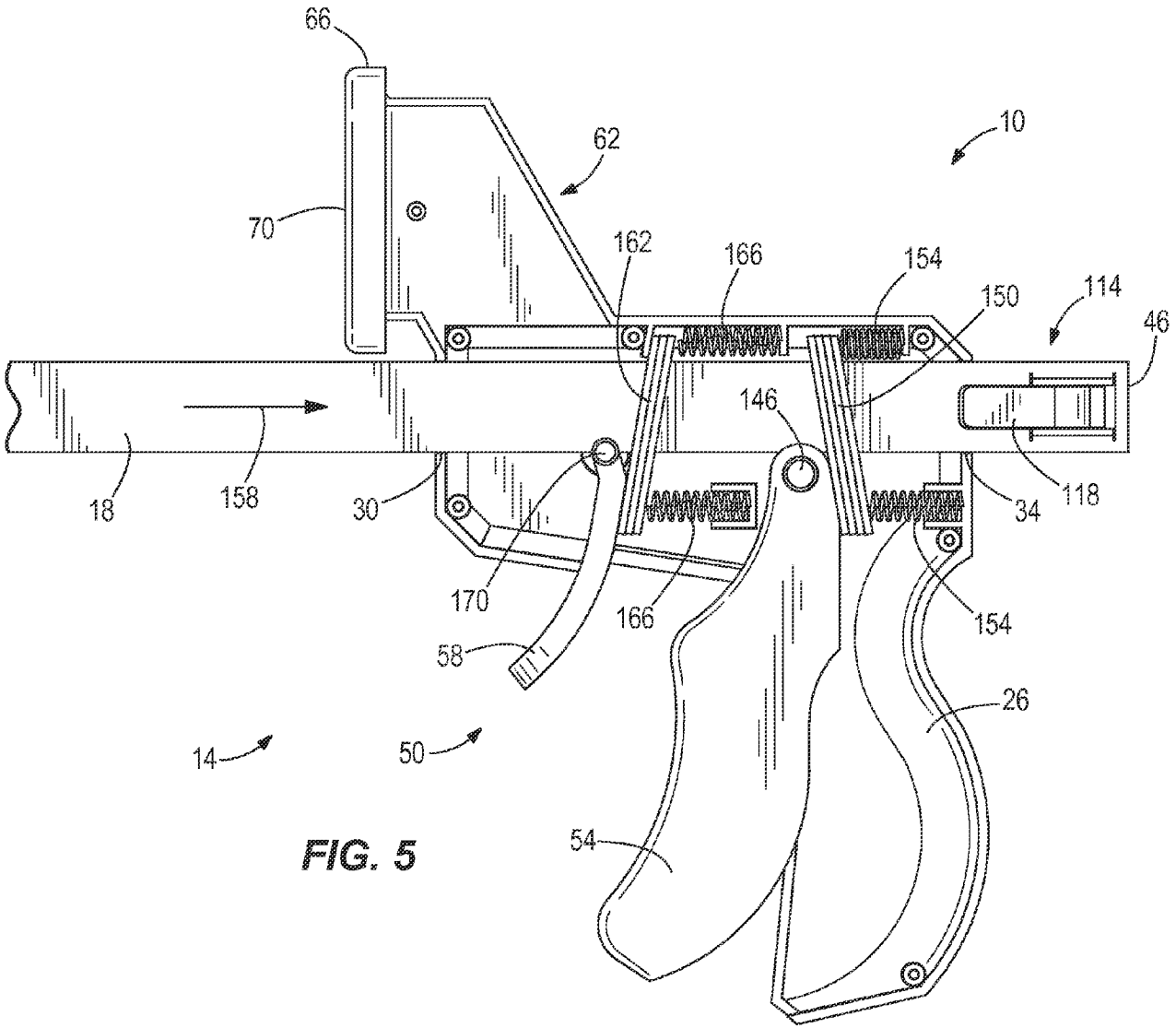
FIG. 5 is a partial perspective view of the combination clamp and spreader tool of FIG. 1 illustrating an actuation assembly with part of a handle removed for clarity.
Figure 6:
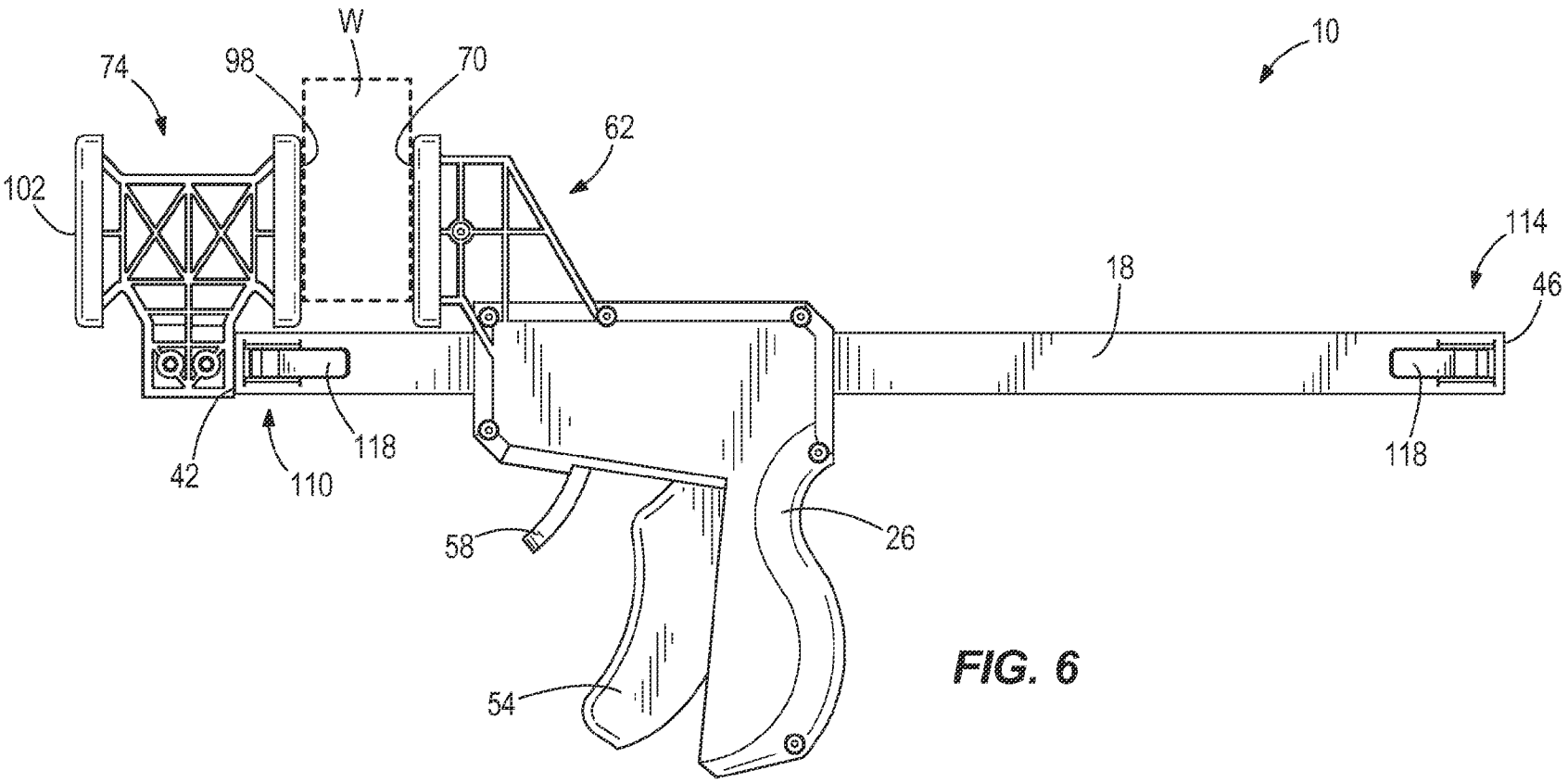
FIG. 6 is a side view of the combination clamp and spreader tool of FIG. 1 in the clamping configuration, clamping a workpiece.

FIG. 5 illustrates the actuation assembly 50 operable to control the movement of the slidable bar 18. Portions of the handle 26 are illustrated as removed in FIG. 5 for clarity. The trigger 54 is actuated by a user to pivot about a pivot pin 146 and is coupled to a first set of gripping plates 150 biased against the trigger 54 by springs 154. When the trigger 54 is actuated, the first set of gripping plates 150 are forced to move against the bias of the springs 154, thereby causing the slidable bar 18 to incrementally move in an actuating direction defined from the first aperture 30 to the second aperture 34 and indicated by arrow 158. A second set of gripping plates 162, biased by springs 166 and coupled to the release trigger 58, prevents the movement of the slidable bar 18 in a direction opposite the actuation direction 158. The release trigger 58 is pivotable about a pivot pin 170 when actuated by a user to release and allow the slidable bar 18 to move in a direction opposite the actuation direction 158. When the release trigger 58 is actuated, the slidable bar 18 is free to be rapidly adjusted by the user. The actuation direction 158 of the slidable bar 18 is the same in both the clamping and the spreading configuration. FIG. 6 illustrates the tool 10 in the clamping configuration with the first span 130 and the first surface 70 and second surface 98 clamped together on a workpiece W.

Figure 7:
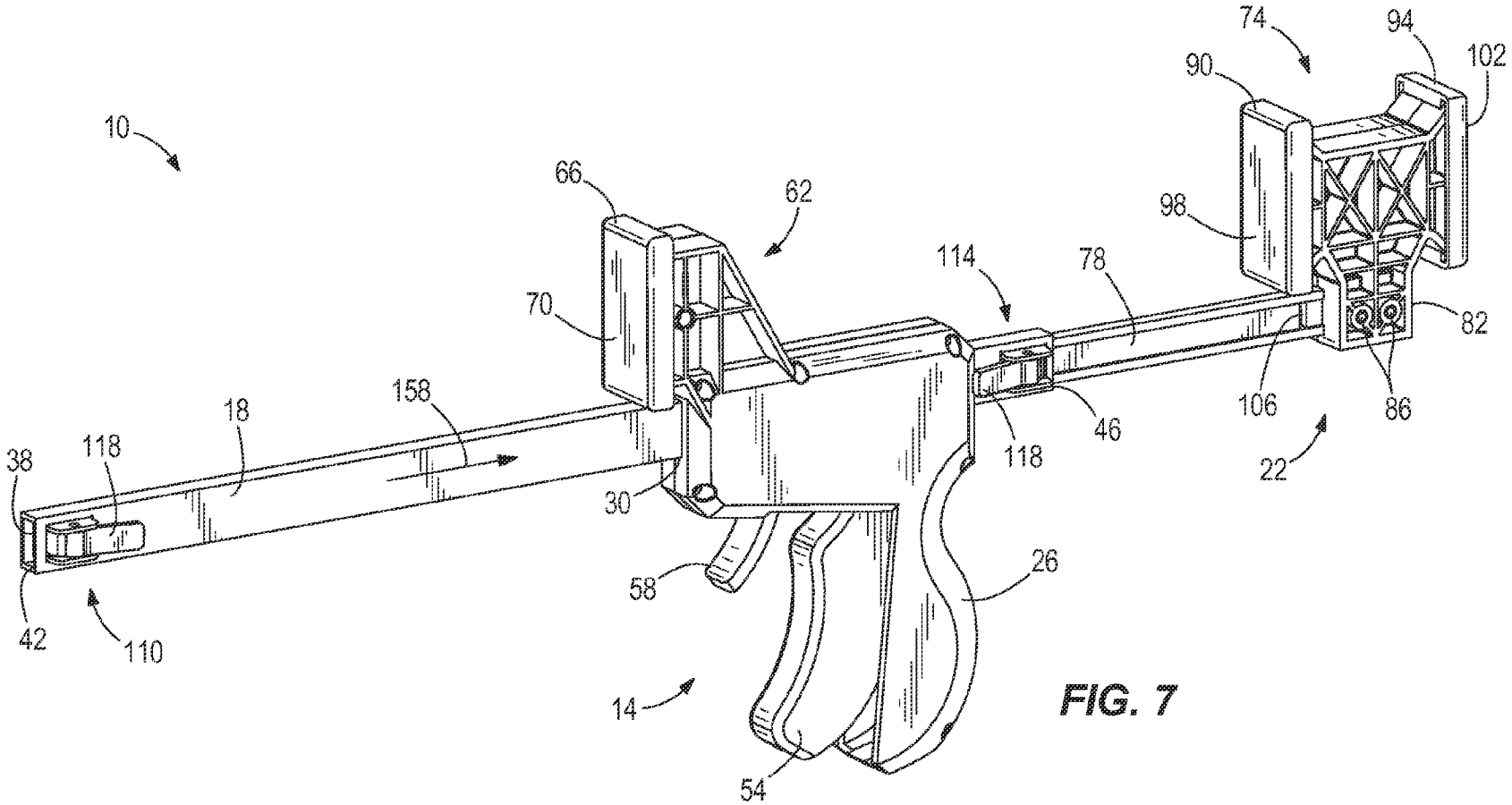
FIG. 7 is a perspective view of the combination clamp and spreader tool of FIG. 1 in a spreading configuration.

FIG. 7 illustrates the combination clamp and spreader tool 10 in the spreading (i.e., jacking, or prying) configuration. The spreading configuration utilizes the inner rod assembly 22 inserted into the second end 46 of the center slot 38 in the slidable bar 18. To switch between the clamping and spreading configurations, the inner rod assembly 22 is completely removed from the slidable bar 18 by the user at one end 42, 46 and inserted into the other end 46, 42. When in the spreading configuration, the actuating assembly 50 still moves the slidable bar 18 in the actuation direction 158 as in the clamping configuration, but now the actuation direction provides a spreading or jacking force between the first surface 70 and the third surface 102.

Figure 8A:
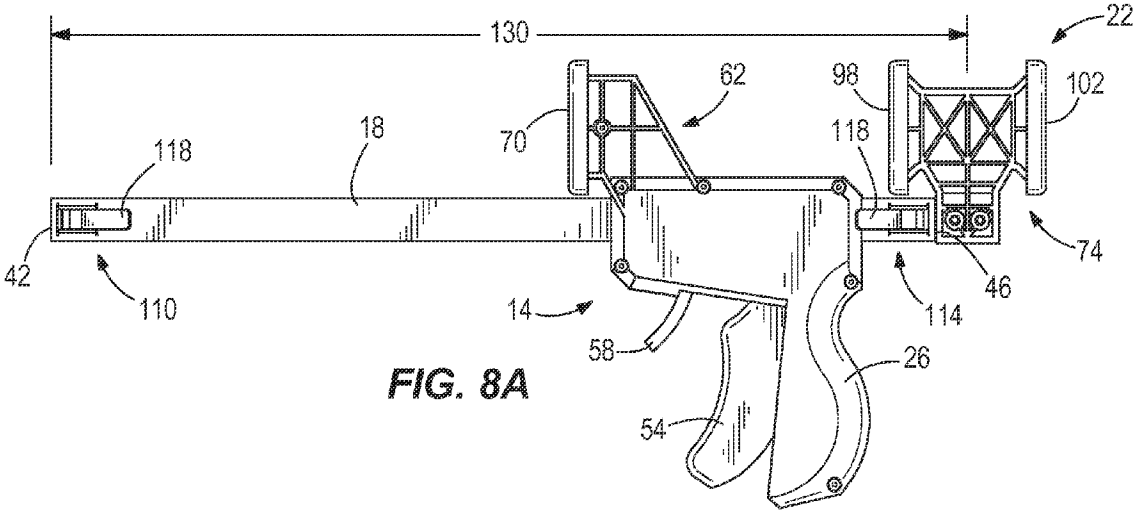
FIG. 8A is a side view of the combination clamp and spreader tool of FIG. 1 in the spreading configuration with a first span.
Figure 8B:
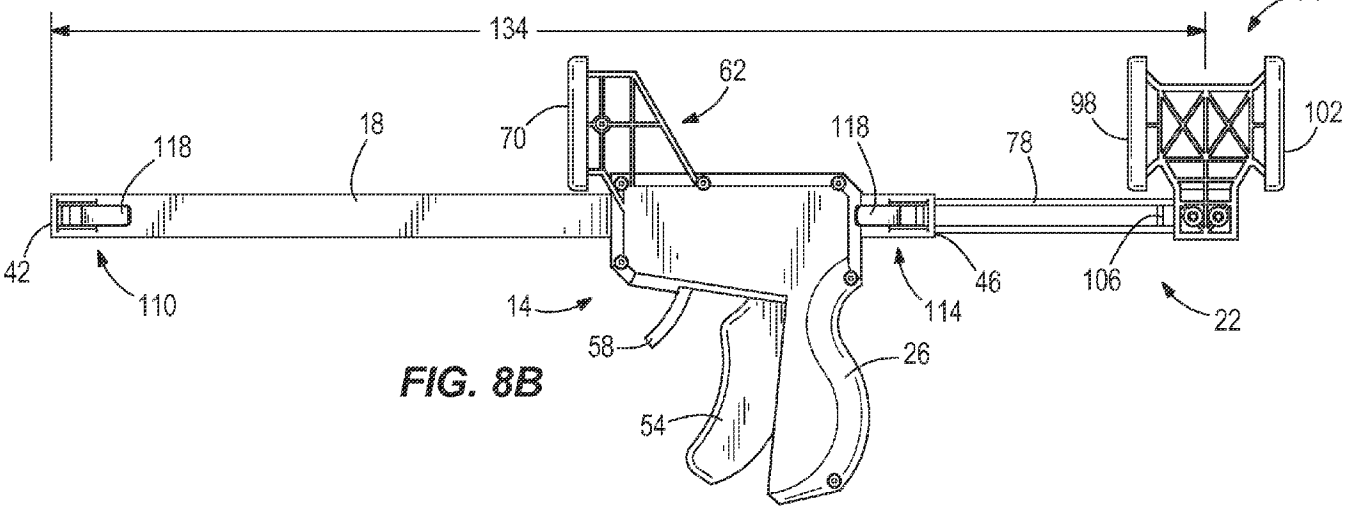
FIG. 8B is a side view of the combination clamp and spreader tool of FIG. 1 in the spreading configuration with a second span.
Figure 8C:
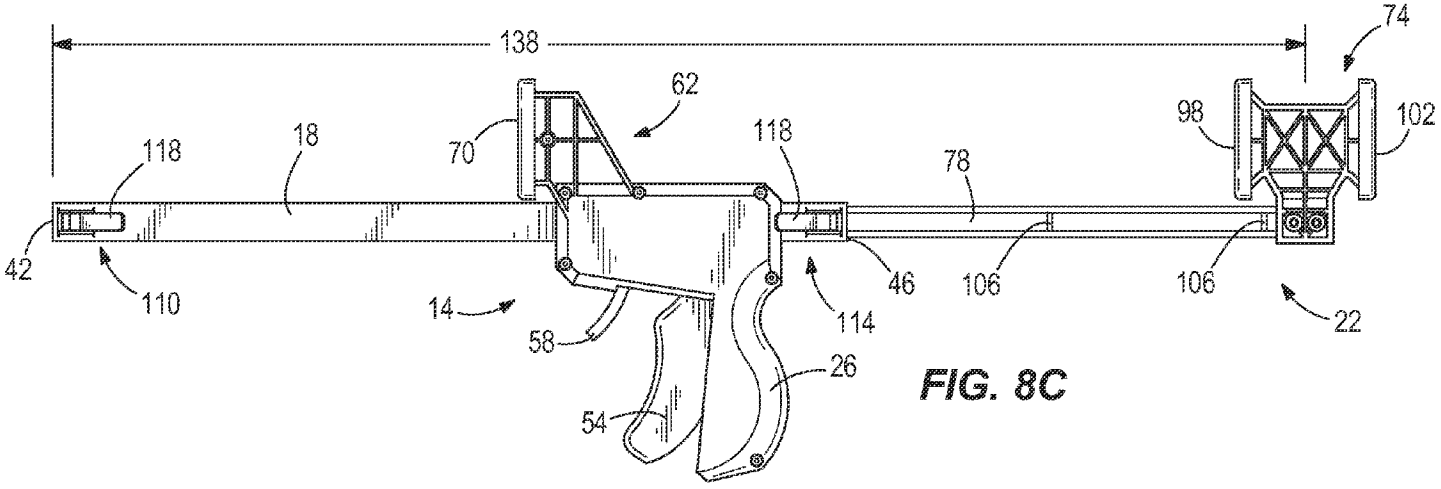
FIG. 8C is a side view of the combination clamp and spreader tool of FIG. 1 in the spreading configuration with a third span.
Figure 8D:
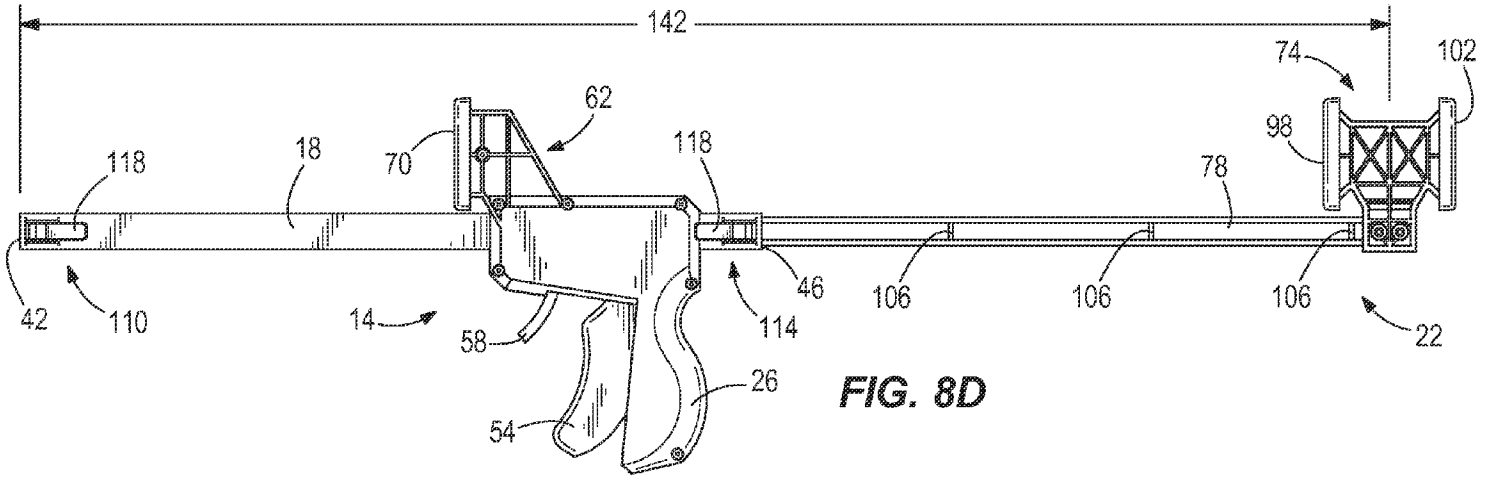
FIG. 8D is a side view of the combination clamp and spreader tool of FIG. 1 in the spreading configuration with a fourth span.
Figure 9:
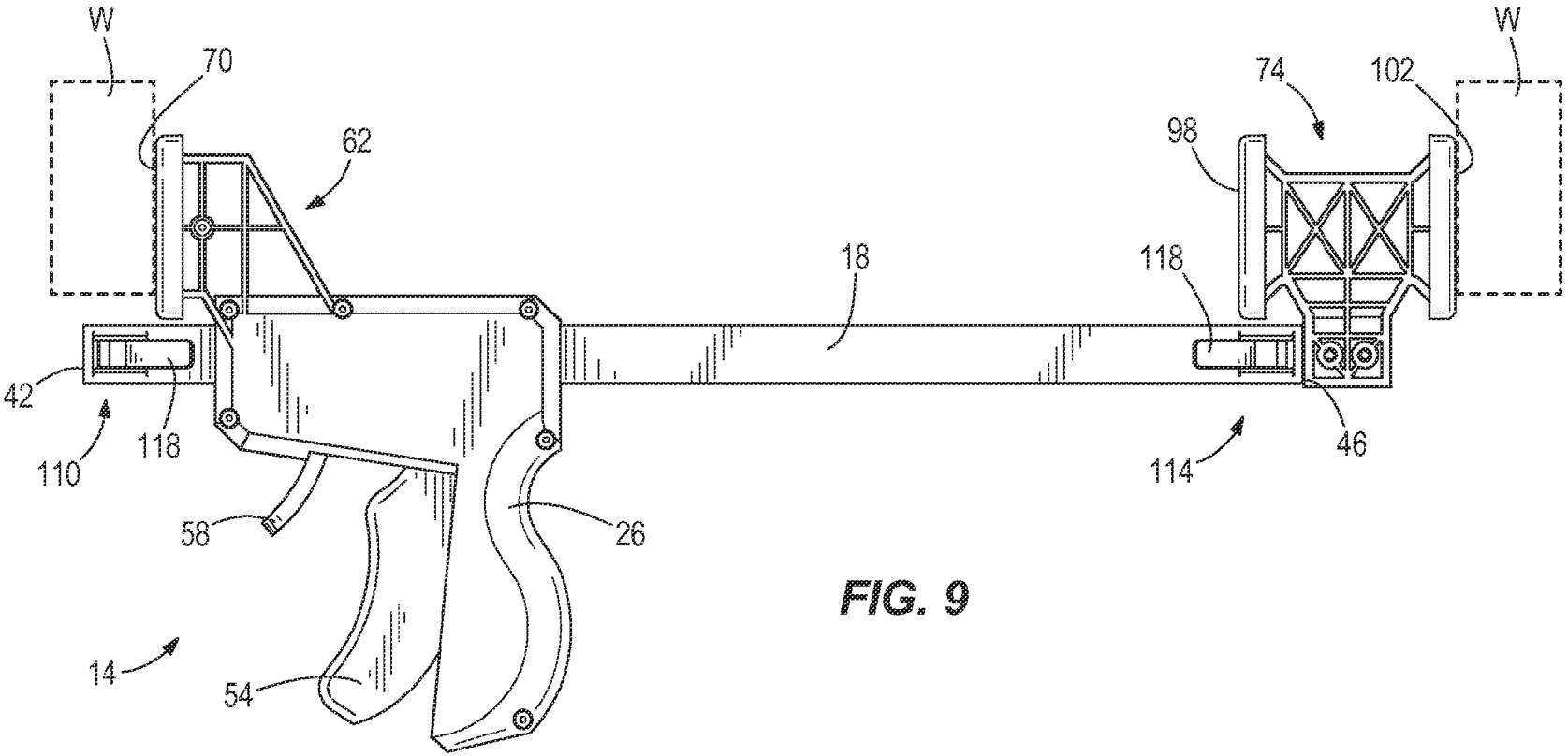
FIG. 9 is a side view of the combination clamp and spreader tool of FIG. 1 in the spreading configuration, spreading a workpiece.

Similar to in the clamping configuration, the clamp and spreader tool 10 has an adjustable span in the spreading configuration. FIG. 8A illustrates the combination clamp and spreader tool 10 in the spreading configuration with the first span 130. The first span 130 now corresponds to the detent mechanism 114 engaging the slot 106 closest to the second jaw portion 74. The first span 130 (FIG. 8A) in the spreading configuration is the same length as the first span 130 (FIG. 4A) in the clamping configuration. Similarly, FIG. 8B illustrates the tool 10 in the spreading configuration with the second span 134. FIG. 8C illustrates the clamp and spreader tool 10 in the spreading configuration with the third span 138 and FIG. 8D illustrates the fourth span 142. The inner rod assembly 22 is thereby adjustable via slots 106 and detent mechanisms 110, 114 to increase or decrease the span of the tool 10 in either the clamping or the spreading configuration. In some constructions, the slots 106 are not evenly spaced along the inner rod 78 to provide spans unevenly spaced apart in the clamping and spreading configurations. FIG. 9 illustrates the tool 10 in the spreading configuration with the first span 130 and the first surface 70 and third surface 102 forcing apart two workpieces W. In the spreading configuration, the tool 10 is additionally able to jack a workpiece off of a work surface by applying the spreading force between the workpiece and work surface.

In some constructions, the second jaw portion 74 only includes a single engagement surface and is rotatably coupled to the inner rod 78 so as to pivot the engagement surface when switching between the clamping and spreading configurations.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A tool for providing a clamping force and a spreading force, the spreading force in an opposite direction of the clamping force, the tool comprising:

a handle assembly including a trigger;

a bar supported by the handle assembly and configured to move relative to the handle assembly when the trigger is actuated, the bar including a slot spanning from a first end of the bar to a second end of the bar;

an inner rod received within the slot; and a detent mechanism operable to selectively couple the inner rod to the bar;

wherein the inner rod is received within the first end and coupled to the bar to provide the clamping force when the trigger is actuated, and wherein the inner rod is received within the second end and coupled to the bar to provide the spreading force when the trigger is actuated.

2. The tool of claim 1, wherein the handle assembly includes a first jaw portion and the inner rod includes a second jaw portion.

3. The tool of claim 2, wherein the first jaw portion includes a first workpiece-engagement surface, and the second jaw portion includes a second workpiece-engagement surface and a third workpiece-engagement surface.

4. The tool of claim 3, wherein the first workpiece-engagement surface and the second workpiece-engagement surface are engaged when the tool is providing the clamping force.

5. The tool of claim 3, wherein the first workpiece-engagement surface and the third workpiece-engagement surface are engaged when the tool is providing the spreading force.

6. The tool of claim 2, wherein the first jaw portion includes a first workpiece-engagement surface and the second jaw portion includes a second workpiece-engagement surface, the second jaw portion rotatably coupled to the inner rod.

7. The tool of claim 1, wherein the inner rod is completely separable from the bar.

8. The tool of claim 1, wherein the detent mechanism includes a pivotable clip coupled to the bar, the pivotable clip configured to be at least partially received in a slot formed in the inner rod to selectively couple the inner rod to the bar.

9. The tool of claim 1, wherein the detent mechanism includes a biased plunger coupled to the bar, the biased plunger configured to be at least partially received in an aperture formed in the inner rod to selectively couple the inner rod to the bar.

10. The tool of claim 1, wherein the inner rod is adjustable relative to the bar to vary a span of the tool.

11. A tool comprising:

a handle assembly including an actuator;

a bar supported by the handle assembly and configured to move relative to the handle assembly when the actuator is actuated, an inner rod coupled to the bar; and a detent mechanism coupled to the bar and configured to selectively lock the inner rod to the bar;

wherein the inner rod is adjusted relative to the bar to vary a span of the tool;

wherein the bar includes a slot spanning from a first end of the bar to a second end of the bar; the inner rod is received within the first end and coupled to the bar to provide a clamping force, and wherein the inner rod is received within the second end and coupled to the bar to provide a spreading force.

12. The tool of claim 11, wherein the span can be adjusted in both a clamping configuration and a spreading configuration.

13. The tool of claim 11, wherein the detent mechanism includes a pivotable clip coupled to the bar, the pivotable clip configured to be at least partially received in a slot formed in the inner rod to selectively couple the inner rod to the bar.

14. The tool of claim 11, wherein the detent mechanism includes a biased plunger coupled to the bar, the biased plunger configured to be at least partially received in an aperture formed in the inner rod to selectively couple the inner rod to the bar.

15. A hand tool comprising:

a handle assembly including a trigger;

a bar supported by the handle assembly and configured to move relative to the handle assembly when the trigger is actuated;

a telescoping inner rod adjustably coupled to the bar to vary a span of the tool and to switch the tool from a clamping configuration to a spreading configuration;

wherein the telescoping inner rod is coupled to a first end of the bar in the clamping configuration and coupled to a second end of the bar in the spreading configuration.

16. The hand tool of claim 15, further including a detent mechanism operable to selectively lock the telescoping inner rod to the bar.

17. The hand tool of claim 15, wherein the handle assembly includes a first jaw portion and the telescoping inner rod includes a second jaw portion.

18. The hand tool of claim 15, wherein the telescoping inner rod is adjustable to provide at least four spans of the tool.

* * * * *